US006918435B2

(12) United States Patent
Dwyer

(10) Patent No.: US 6,918,435 B2
(45) Date of Patent: Jul. 19, 2005

(54) FLUID TO GAS HEAT EXCHANGERS

(76) Inventor: Robert Charles Dwyer, 2 Farwell Road, Sidcup, Kent (GB), DA14 4LG ( * ) Notice: Subject to any disclaimer, the term of this patent is extended or adjusted under 35 U.S.C. 154(b) by 0 days.

(21) Appl. No.: 10/472,649

(22) PCT Filed: Mar. 21, 2002

(86) PCT No.: PCT/GB02/01356

§ 371 (c)(1),
(2), (4) Date: Sep. 22, 2003

(87) PCT Pub. No.: WO02/075232

PCT Pub. Date: Sep. 26, 2002

(65) Prior Publication Data

US 2004/0108105 A1 Jun. 10, 2004

(30) Foreign Application Priority Data

Mar. 21, 2001 (GB) ..... 0107107

(51) Int. Cl.[7] ..... F28F 1/32
(52) U.S. Cl. ..... 165/171; 29/890.047; 165/177
(58) Field of Search ..... 165/181, 177, 165/185, 133, 134.1, 171; 29/890.03, 890.043, 890.047

(56) References Cited

U.S. PATENT DOCUMENTS

| | | | | |
|---|---|---|---|---|
| 3,246,120 A | * | 4/1966 | Brandenburg | 165/171 |
| 3,305,011 A | * | 2/1967 | Smith, Jr. | 165/171 |
| 3,357,763 A | | 12/1967 | Toper | |
| 3,460,613 A | * | 8/1969 | Kritzer | 165/171 |
| 3,648,768 A | | 3/1972 | Scholl | |
| 4,094,301 A | * | 6/1978 | Sorenson et al. | 165/171 |
| 4,235,281 A | * | 11/1980 | Fitch et al. | 165/171 |
| 4,326,583 A | * | 4/1982 | Rudd | 29/890.038 |
| 5,201,119 A | | 4/1993 | Mizuno et al. | |
| 5,411,079 A | | 5/1995 | Sasaki et al. | |
| 5,469,915 A | * | 11/1995 | Cesaroni | 165/171 |
| 6,032,727 A | * | 3/2000 | Martins | 165/149 |
| 6,192,976 B1 | * | 2/2001 | Yoshida et al. | 165/171 |
| 2002/0102417 A1 | * | 8/2002 | Schutt et al. | 165/133 |

FOREIGN PATENT DOCUMENTS

| | | |
|---|---|---|
| DE | 1961379 | 6/1971 |
| EP | 0354569 | 2/1990 |
| EP | 0834704 | 4/2001 |
| FR | 1057681 | 3/1954 |
| GB | 1393905 | 5/1975 |
| GB | 2051338 | 1/1981 |
| JP | 11198640 | 10/1999 |
| WO | WO 02/04036 | 1/2002 |

* cited by examiner

*Primary Examiner*—Teresa J. Walberg
(74) *Attorney, Agent, or Firm*—Clifford W. Browning; Woodard, Emhardt, Moriarty, McNett & Henry LLP

(57) ABSTRACT

A fluid to gas heat exchanger comprising a plurality of fin-tube elements (6). Each fin-tube element is an integral extrusion and comprises tubes portions (61) for carrying heat exchange fluid and fin portions (62) for dissipating heat. The fin portions and tube portions run in the same direction side by side.

34 Claims, 8 Drawing Sheets

FLUID TO GAS HEAT EXCHANGERS

This invention relates to fluid to gas heat exchangers which are sometimes also referred to as coils, for example, heating, cooling or condensing coils.

Such fluid to gas heat exchangers are widely used in, for example, heating ventilation and air conditioning. Heat is transferred between a heat exchanger fluid, flowing within the interior of the heat exchanger, and the surroundings of the heat exchanger by a flow of gas, typically air; over the external surfaces of the heat exchanger. Clearly a fluid to gas heat exchanger is distinct from a fluid to liquid heat exchanger where the presence of an external liquid means that many other considerations are important.

A typical existing fluid to gas (air) heat exchanger is shown in FIG. 1. This conventional heat exchanger comprises a supporting frame 1, and a plurality of tube portions 2 arranged for carrying a heat exchange fluid between a flow header 3 and a return header 4. It will be appreciated that at a location remote from the portion of the heat exchanger shown in FIG. 1, the tube portions 2 are joined together to complete fluid communication paths between the flow and return headers 3, 4. To encourage the desired heat flow into or out, of the heat exchange fluid flowing within the tube portions 2, a plurality of fins 5 are provided which run generally at right angles to the tube portions 2. Each of these fins 5 is typically an extremely thin piece of metal provided with a plurality of apertures through which the tube portions 2 pass. The fins 5 are conventionally extremely closely packed, a typical spacing or pitch might be in the order of 2 to 5 mm. Further, although the fins are in most part metallic, typically aluminum, they are often coated with a protective polyester coating to help prevent their degradation when exposed to the environment. A further point to note is that in a normal manufacturing procedure, after the (typically copper) tube portions 2 are inserted through the apertures in the fins 5, suitable expanding rods, or ball bearings, are driven through the tube portions 2 to expand the copper into contact with the periphery of the apertures in the fins 5. After this step is complete the tube portions are connected together to provide the desired flow paths through the heat exchanger.

Such existing fluid to gas heat exchangers have a number of problems.

First of all, the process for their manufacture is extremely time consuming, labour intensive, and very hard, if not impossible, to automate. Conventional heat exchange coils are often custom built and involve a lot of hand working or finishing. In some cases the welding or soldering is not 100% effective and the number and type of such joints needed in complex coils can lead to a risk of leaks.

Further, the efficiency of the heat exchanger relies on the conduction of heat from the tube portions 2 and along the fins 5 or vice versa. However, the very structure of the fins 5 and tubes 2 and their method of connection works against this desirable heat flow. There is only a mechanical bond between the exterior of the copper tube portions 2 and the apertures in the fins and this is not good at conducting heat. The problem is made worse by the polyester coating which is typically provided on the fins 5 and the fact that the contact surface area between the periphery of each aperture in the fin and the tube portion is small. Further, since the fins are generally stamped out of thin sheet, they have a shape that is inherently poor at transferring heat towards or away from the tube portions. In any given heat existing heat exchanger of this type, one or more of these factors will combine to mean that there is a fast temperature change between the outer surface of each tube portion and the regions of the fin adjacent to each aperture. This is another way of saying that because the conduction between the tube portions 2 and the fin portions 5 is poor, heat transfer in either direction is not as efficient as it might be and thermal efficiency is sacrificed A further problem with conventional heat exchangers is that the closeness of the fins 5 makes them almost impossible to effectively clean or sterilise against *legionella* bacteria.

Yet another disadvantage is that existing heat exchangers are relatively heavy for their size and awkward to handle.

Furthermore, such conventional heat exchangers are more economically manufactured if the width, i.e. the direction in which the tube portions 2 run, is maximised whilst the height is minimised. However, at least in some circumstances, such a shape is in direct opposition to the shape which is desired for other reasons. For example, air handling units should preferably be square or near square in cross section.

A further disadvantage in conventional fluid to gas heat exchangers is that fins are thin and therefore can easily be damaged during manufacture, installation, or when on site and in service. Furthermore, even when provided with a polyester coating, the life of fins 5 is relatively short compared with that of the other components in the heat exchange coil.

Those who are experienced in the art of heat exchangers know that achieving counterflow is attractive for maximising efficiency. Counterflow means arranging for the heat exchange fluid flowing inside the tube portions 2 to travel in a direction opposite to the airflow or other fluid flow across the external portions of the heat exchanger. This helps to maximise the temperature difference between the two fluids between which heat is being exchanged. As can be seen from FIG. 1, in conventional heat exchangers, the major effect is crossflow rather than counterflow. There is a possibility of counterflow where the heat exchanger is deep in the direction of incoming airflow, but otherwise there is minimal possibility for counterflow.

It is an object of at least some embodiments of the present invention to provide a heat exchanger which addresses one or more of the problems discussed above.

According to a first aspect of the present invention there is provided a fluid to gas heat exchanger comprising at least one fin-tube element which comprises at least one tube portion for carrying heat exchange fluid and at least one respective fin portion which is in contact with the tube portion and arranged for encouraging exchange of heat between fluid in the tube portion and the surroundings, wherein the tube portion and fin portion run side by side.

According to a second aspect of the present invention there is provided a fin-tube element for a fluid to gas heat exchanger, the element comprising at least one tube portion for carrying heat exchange fluid and at least one respective fin portion which is in contact with the tube portion and arranged for encouraging exchange of heat between fluid in the tube portion and the surroundings, wherein the tube portion and fin portion run side by side.

It will be clear that the term surroundings should be considered broadly and might include the air in a room, the atmosphere or a gas arranged to flow over the heat exchanger within a containing structure.

The present invention is particularly suited for use in the ventilation, heating or air conditioning field. In such cases the gas will almost always be ambient air.

The provision of fins which extend in a direction which is generally parallel to the direction of the tubes leads to a number of advantages compared with existing arrangements where the fins are at right angles to the tubes. For example, in some cases longitudinal air flow along the outer surface of the tubes can be achieved, this facilitates a counterflow situation along the length of the tube to maximise efficiency. The tube and fin arrangement can also allow various structural and manufacturing advantages such as improved strength and simpler manufacturing techniques. Additional advantages facilitated by the fin-tube arrangement will become clearer by considering the following.

Preferably the fin portion runs along substantially the whole length of the tube portion. Preferably substantially the whole length of the fin portion is in contact with the tube portion.

The fin-tube element may be integral. The fin-tube element may be an extrusion. The fin-tube element may be of extruded aluminium. An integral fin-tube element can dramatically increase the efficiency of heat flow between the tube portion(s) and fin portion(s).

Preferably the fin-tube element comprises a plurality of tube portions, which are preferably linked to one another via respective fin portions. Each tube and its respective fin portion or portions may be integral. The ability to pre-fabricate fin-tube elements comprising a plurality of tube portions, can significantly ease manufacture.

In general, the heat exchanger will comprise a plurality of fin-tube elements. In such cases, preferably each of the fin-tube elements comprises a plurality of tube portions.

The shape of the fin portion or portions may be chosen so as to encourage heat transfer. The fin portion or portions may have a sinuous profile. Each fin portion may have root portion where it meets its respective tube portion, this root portion may be thicker than the remainder of the fin portion.

In cases where there are a plurality of fin-tube elements, the elements may be shaped and arranged to allow dense packing of tube portions, in particular, the spacing between adjacent fin-tube elements may be less than the outside diameter of the tube portions. This may be facilitated by staggering the position of the tube portions in adjacent fin-tube elements.

The tube portions may, for example, have a circular cross-section or an oval cross-section. The use of an oval cross-section may allow closer packing than a circular cross-section.

Preferably the shape of each fin-tube element, and/or the inter-arrangement of fin-tube elements where more than one fin-tube element is provided, is chosen to encourage heat transfer to a fluid, such as air, flowing past the fin-tube element(s). The shape and/or inter-arrangement may be selected to encourage free flowing turbulent flow past the fin-tube element(s).

The heat exchanger may comprise at least one header, an interior of which is in fluid communication with the interior of the tube portion. Typically there will be a pair of headers between which the tube portion is disposed so that there is a fluid path between the interiors of the two headers via the tube portion.

Typically the or each header will be arranged to be in fluid communication with a plurality of tube portions.

The tube portion may be connected to the header by use of adhesive, such as epoxy resin. The tube portion may be connected to the header by use of suitable solder or welding techniques. The tube portion may be connected to the header by use of a nozzle member having a portion arranged to be located within the tube portion. A combination of any of these techniques with one another as well as with other techniques may be used.

The header may comprise a tube receiving portion. The operation of connecting the tube portion to the header may be at least partially performed from a side of the tube receiving portion which will be in the eventual interior of the header. The header may be of at least two initially separate parts such that at least part of the operation of connecting the tube portion to the tube receiving portion of the header may be carried out from the side of the tube receiving portion that will eventually face the interior of the header.

The heat exchanger may comprise a plurality of sub units each of which sub units comprise a respective spaced pair of headers between which is disposed at least one respective fin-tube element having at least one tube portion to provide a fluid path between the interiors of the two headers.

Adjacent headers in the heat exchanger may be in fluid communication with one another.

The interior of a first header in one pair may be in fluid communication with the interior of a first header in another pair. The interior of the second header in said one pair may be in fluid communication with the interior of the second header in said other pair.

The sub units may be arranged and connected together in such a way as to allow counterflow heat exchange to occur. For example, two sub units may be placed one behind the other in a direction of exterior gas flow through the heat exchanger, and the heat exchange fluid may be routed first through the sub unit which receives the exterior gas flow second and second through the sub unit that receives the exterior gas flow first.

Similar counter flow may be achieved within a sub unit, or in a heat exchanger not having sub units, by providing appropriate chambers and connections within some or all of the headers.

A connecting nipple may be provided for physically connecting adjacent headers and providing a fluid communication path therebetween.

The heat exchanger when including a pair of headers connected by at least one fin-tube element, and indeed each of the sub units when present, form a rigid structure in themselves. The need for a supporting frame can therefore be avoided.

According to another aspect of the present invention there is provided a fluid to gas heat exchanger sub unit comprising a spaced pair of headers between which is disposed at least one fin-tube element having at least one tube portion to provide a fluid path between the interiors of the two headers.

According to yet another aspect of the present invention there is provided a method of manufacturing a fluid to gas heat exchanger having at least one pair of headers and at least one fin-tube element which comprises at least one tube portion for carrying heat exchange fluid and at least one respective fin portion which is in contact with the tube portion and arranged for encouraging exchange of heat between fluid in the tube portion and the surroundings, the method comprising the step of:

connecting the at least one fin-tube element between the pair of headers so as to provide a fluid communication path between interiors of the headers via the tube portion.

Preferably the tube portion and fin portion run side by side

Typically, the method will include connecting a plurality of fin-tube elements between the pair of headers. The method may include the step of using pre-fabricated standard fin-tube and header components. The method may comprise the further step of cutting the or each fin-tube element to a desired length. The method may comprise the further step of cutting at least some of the header components to a desired length.

The step of connecting the fin-tube element to the headers may comprise processing from the eventual interior of each header. This processing from the interior can be necessary to ensure an effective seal against the heat exchange fluid in use.

Each header may comprise a tube receiving portion and at least one other part which is initially separate from the tube receiving portion so as to allow access to a side of the tube receiving portion which will eventually face the interior of the header, and the step of connecting the fin-tube element to each header may, comprise the steps of first performing at least part of the operation for connecting the tube portion to the header from the side of the tube receiving portion which will eventually face the interior of the header and second, connecting together the tube receiving portion and the at least one, other part.

The method may comprise the steps of making a plurality of sub units by connecting at least one respective fin-tube element between a respective pair of headers so as to provide a fluid communication path between interiors of the headers via the tube portion and connecting together the sub units to form the heat exchanger.

Preferably connections are made between the headers.

Embodiments of the present invention will now be described by way of example only with reference to the accompanying drawings in which.

Figure 1:
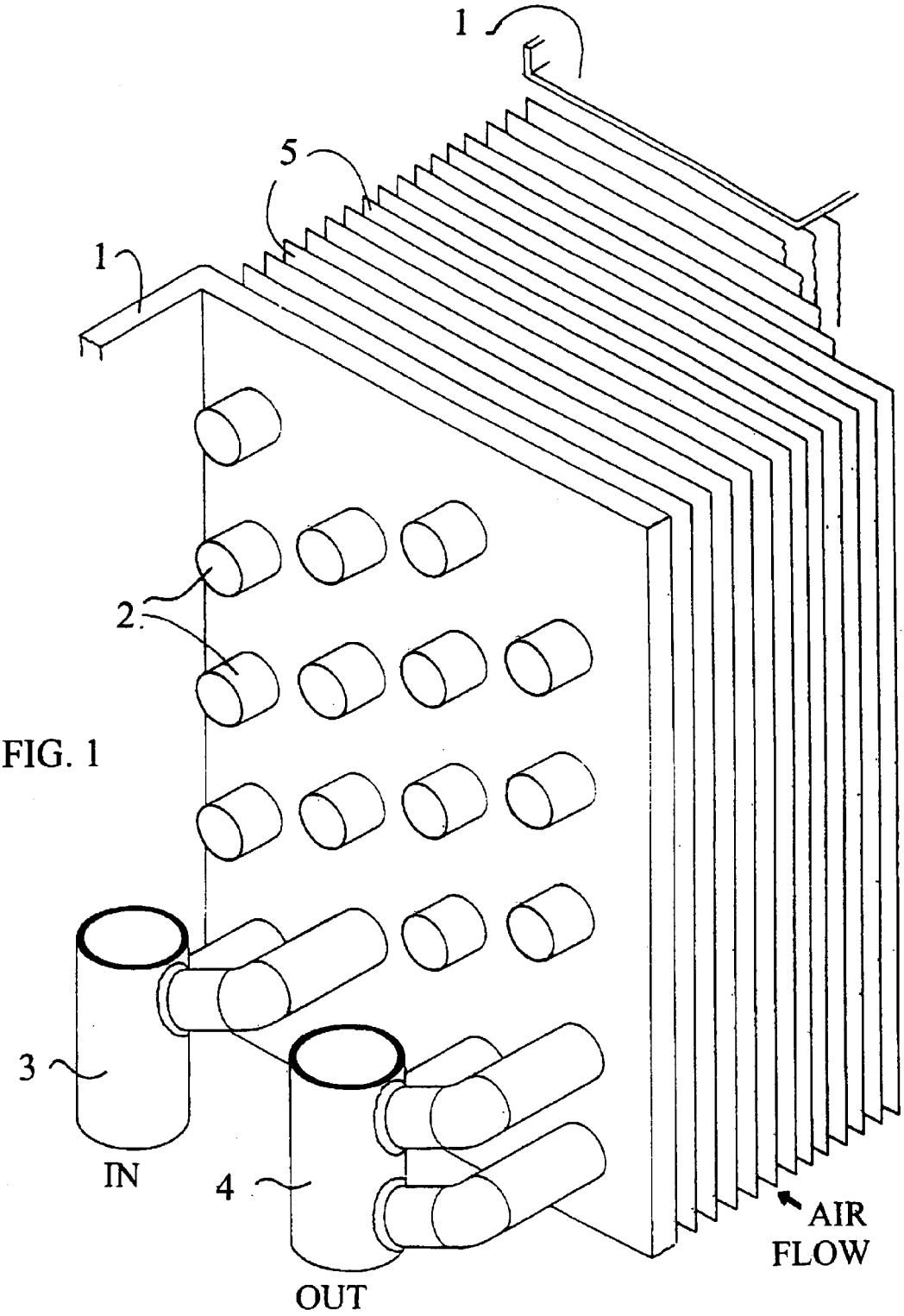
FIG. 1 is a schematic perspective view of part of a conventional fluid to gas heat exchanger.
Figure 2:
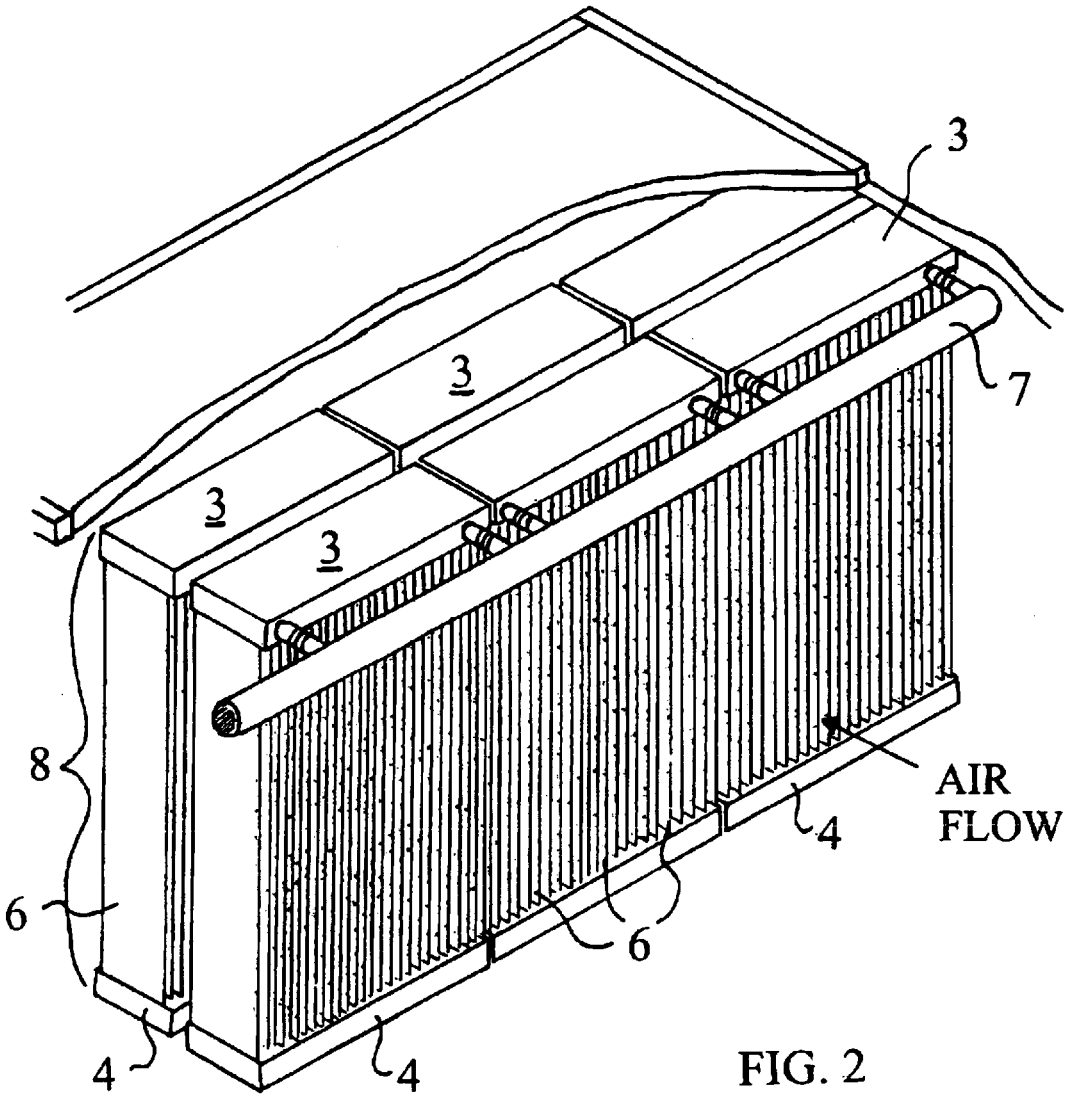
FIG. 2 is a schematic perspective view of a fluid to gas heat exchanger which embodies the present invention.

FIG. 2 shows a fluid to gas heat exchanger which generally comprises a plurality of fin-tube elements 6 connected between respective pairs of headers 3, 4. In the pair of headers 3, 4, one header will act as a flow header 3 and the other will act as a return header 4. Each of the headers 3, 4 will be connected either directly or via internal connections to pipework allowing the transport of heat exchange fluid to and away from the heat exchanger. In FIG. 2 only one such piece of pipework 7 is shown. The structure and arrangement of the headers 3, 4 and fin-tube elements 6 can be more clearly seen in FIGS. 3 to 6 and will be described in detail below.

In the heat exchanger shown in FIG. 2, there are six sub units 8 each of which comprises a respective pair of headers 3, 4 and a respective set of fin-tube elements 6 disposed between the pair of headers 3, 4. Each sub unit 8 forms a rigid structure in its own right and if appropriately connected could in fact function as a heat exchanger on its own. Thus the heat exchanger shown in FIG. 2 can be considered to have a modular structure and this modularity is one of the important ideas in the present application.

Although the connections between the six modules or sub units 8 provided in the heat exchanger shown in FIG. 2 are not detailed, it will be appreciated that the arrangement can be used to achieve counterflow such that the heat exchange fluid is first fed through the row of sub units 8 which are furthest removed from the entry point of external air flow through the heat exchanger and only then fed through the row of sub units 8 which receive the air flow first. Further, it will be appreciated that there is nothing limiting the number of sub unit rows to two, and where there are more rows of modules, the counterflow idea can still be used through the whole heat exchanger.

Figure 3:
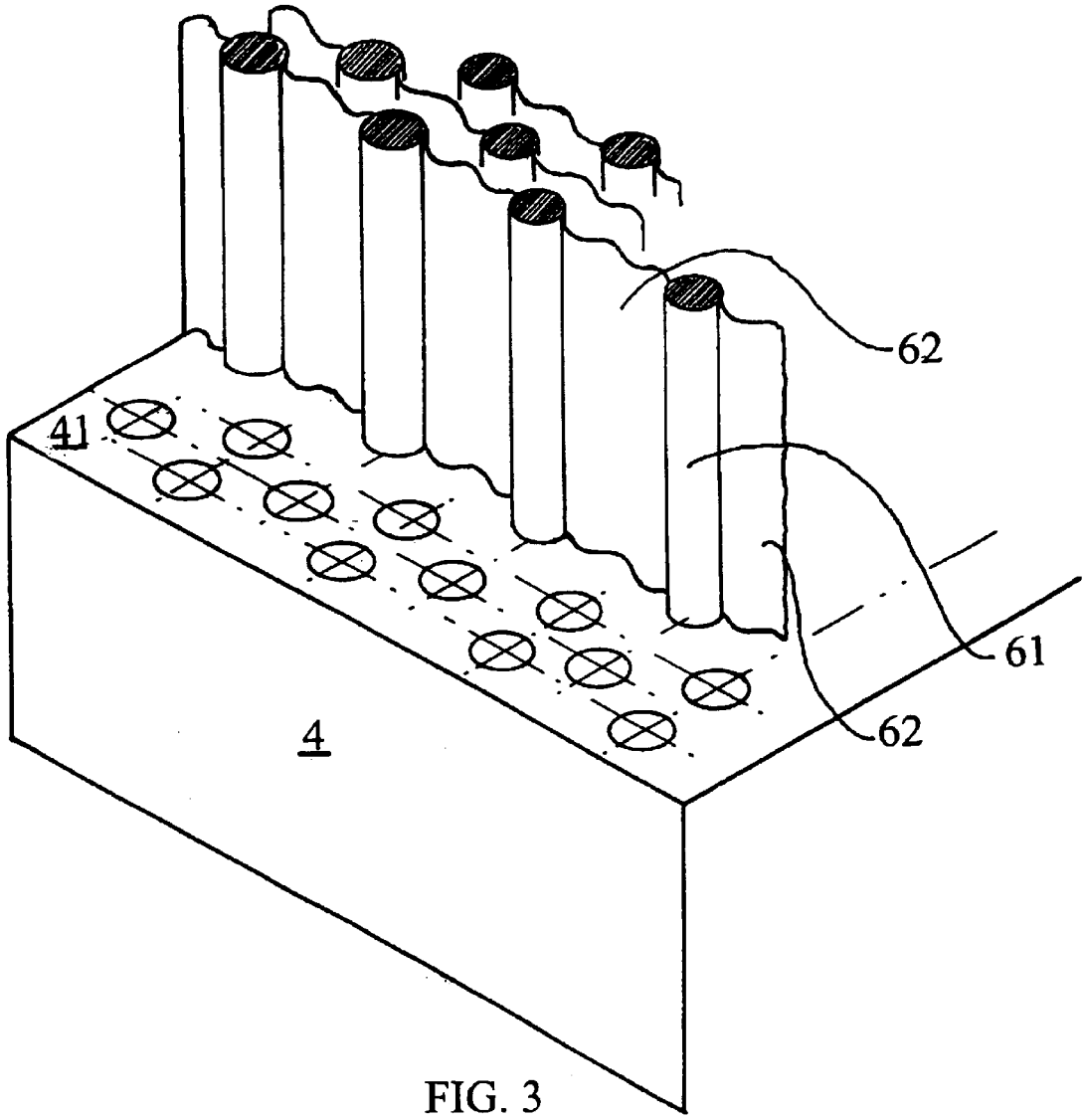
FIG. 3 is a schematic perspective view of part of the heat exchanger shown in FIG. 2 to aid in understanding.
Figure 5:
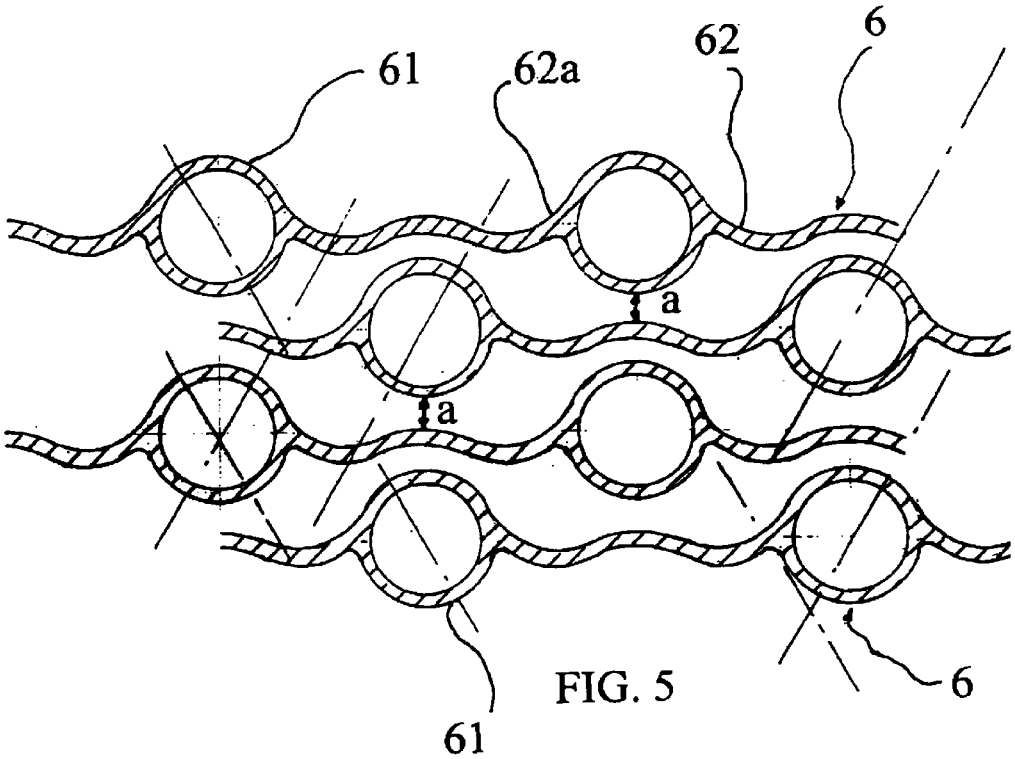
FIG. 5 is a sectional view through three fin-tube elements of the type included in the heat exchanger shown in FIG. 2.
Figure 4:
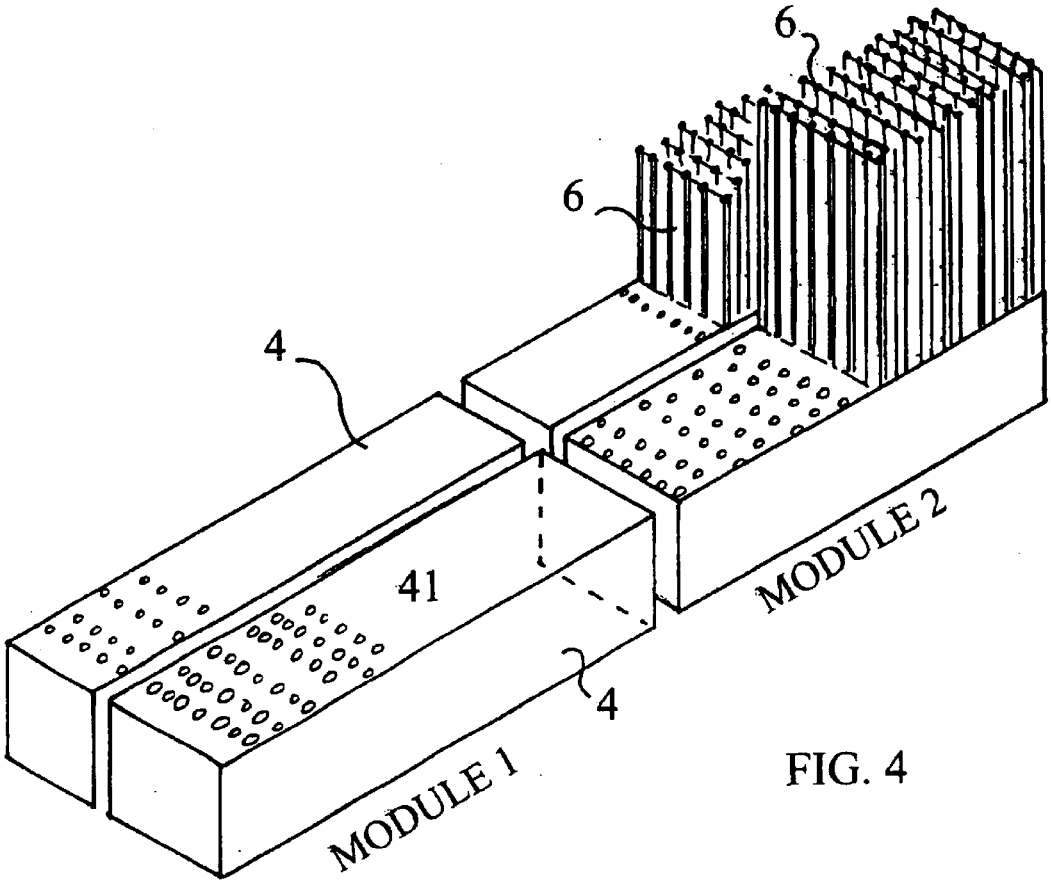
FIG. 4 is another schematic perspective view of part of the heat exchanger shown in FIG. 2 to aid understanding.

Referring particularly to FIGS. 3 and 5, each fin-tube element 6 consists of a plurality of tube portions 61 which are linked by respective fin portions 62. It will also be seen however, that the fin-tube element 6 terminates in a fin portion 62 at each end and thus as well as there being fin portions 62 linking the tubes 61 there are also terminating fin portions 62. The longitudinal length of the tubes 61 and fin portions 62 run substantially parallel.

In the present embodiment, each fin-tube element 6 comprises four tube portions 61, three linking fin portions 62 and two terminating fin portions 62. However, it will be appreciated that in practice any desired number of tube portions 61 and fin portions 62 may be used.

It should be noted that the fin-tube element 6 is integral. That is to say that all of the fin portions 62 and tube portions 61 are of one piece of material. In the present embodiment each fin-tube element 6 is an aluminium extrusion.

As best seen in FIG. 5, where each fin portion 62 meets a respective tube portion 61, the fin portion has a root portion 62*a* which is thicker than the remainder of the fin portion 62. This arrangement helps to encourage a flow of heat between the tube portion 61 and the fin portion 62 in either direction. In terminology used in the field of heat exchangers, the root portion 62*a* helps to maximise fin efficiency. This is achieved at least in part by increasing the efficiency of the secondary surface area of the fin portions 62. The primary surface area of a heat exchanger is considered to be that region which reaches a temperature which is substantially the same as the temperature of the fluid flowing within the tube portion 61, whereas the secondary surface area can be considered to be that portion where there is a significant temperature difference between the fin portion and the fluid flowing in the tube portion 61.

As can be seen most clearly in FIGS. 3 and 5, the tube portions 61 in adjacent fin-tube elements 6 are arranged in a staggered formation. This allows the spacing between adjacent fin-tube elements 6 (their pitch) to be smaller than the external diameter of the tube portions 61.

Further, each of the fin portions 62 has a sinuous shape. This sinuous shape is chosen for two reasons. One is that it encourages there to be a sinuous path for airflow through the heat exchanger and the other is that, it facilitates close packing. As shown in FIG. 5, the shape of the fin portion 62 has been chosen, so that the spacing a where the fin portion 62 of one fin-tube element 6 comes closest to the tube portion 61 of another fin-tube element 6 is substantially constant throughout the whole of one sinuous air passage between the two adjacent fin-tube elements 6 and preferably in all such sinuous air passages. It can be seen that in this embodiment, the midpoint of each fin portion 62 substantially coincides with a line linking the centres of the two closest tube portions 61 in that fin-tube element 6. This feature of the fin-tube element 6 facilitates keeping the spacing a constant.

Consideration of the airflow path through the heat exchanger is of importance, since creating a turbulent flow up to a certain limit will improve heat transfer, whereas beyond that limit, the efficiency of heat transfer will decrease. It is desirable that the arrangement of air passages through the heat exchanger is such that there is a turbulent but free flowing airflow.

Each of the flow and return headers 3, 4 is generally shaped as a box section and has a tube receiving portion 31, 41 which is provided with a plurality of apertures for receiving the ends of the tube portions 61 in the fin-tube elements 6. Thus, clearly where the fin-tube element 5, 6 are to be arranged so that the tube portions 61 have a staggered arrangement, the corresponding apertures in the headers 3, 4 must also have a staggered arrangement. As can be seen in FIG. 3, it also follows that the centres of the apertures for one fin-tube element 6 are spaced, in a longitudinal direction of the header 3, 4, from the apertures for the adjacent fin-tube element 6 by a distance which is less than the diameter of the apertures themselves.

Each of the tube portions 61 must project into and preferably slightly through their corresponding aperture in the tube receiving portion 31, 41. Thus, although the fin portions 62 run side by side along the respective tube portions 61 for substantially the whole length of the tube portions 61, each end of each tube portion 61 must project a little way beyond its respective fin portions 62 to allow insertion into the appropriate apertures.

Figure 6:
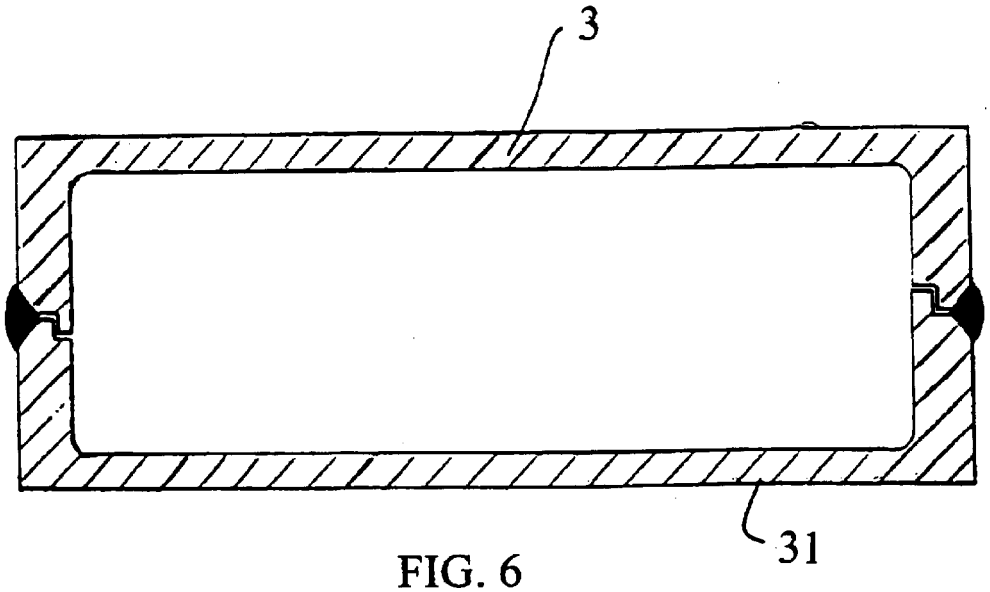
FIG. 6 is a schematic sectional view of a two-part header of the type provided in the heat exchanger of FIG. 2.

Whilst as mentioned above, each header 3, 4 has the shape of a box section, in the present embodiment this box section is in fact made up of two halves as shown for one of the headers in FIG. 6. The headers 3, 4 are provided in two halves which may be appropriately fixed together. This means that with the header in two parts, when the tube portions 61 are inserted into their respective apertures, at least some of the processing used in fixing the tube portions to the tube receiving member 31, 41 can be carried out from what will eventually be the inside of the header 3, 4.

In the present embodiment, both longitudinal portions of the header 3,4 are aluminium extrusions and a preferred fixing technique for fixing the tubes to the headers, and the two halves of the header together, is an aluminium welding or soldering technique using a commercially available solder compound available from Techno-weld Ltd of Aston Works, West End, Aston, Oxfordshire OX18 2NP United Kingdom.

Whilst a very good connection and seal can be obtained using this technique, it is considered that access to the side of the tube receiving portion 41, 31 which will be the interior of the header 3, 4 is necessary, when connecting the tube portions 61 to the header 3, 4.

However, in alternatives, different fixing and sealing techniques may be used such as providing a bath of epoxy resin on the external surface of the tube receiving portions 41, 31 during assembly, such that access to the interior of the headers 3, 4 is not required. Of course, in this case it would not be necessary to provide a two-part header of the type shown above. A commercially available adhesive called Eurobond AC121308ML may be used for fixing and sealing the components.

Although not shown in detail, to complete the headers 3, 4, end caps are provided to close the open ends of the extruded parts (or extruded part if a one-part box section header is used). These end caps may be fixed into position using the same techniques mentioned above.

In the present embodiment, simple single compartment headers 3, 4 are used which are arranged so that there is a fluid communication path between the whole of the interior of a first header 3 in a respective pair through the tube portions 61 of all of the fin-tube elements 6 in that sub unit 8 to the entire interior of the other header 4 in the respective pair.

Figure 7:
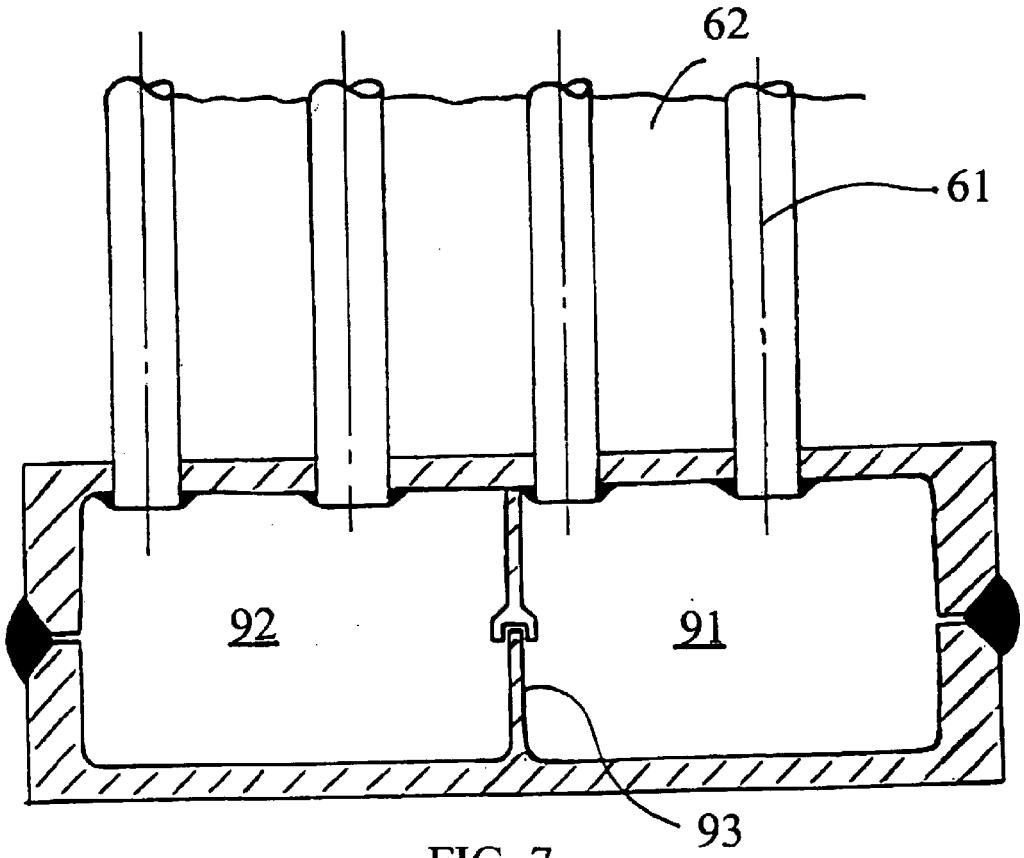
FIG. 7 is a schematic sectional view of an alternative two-part header.

However, in alternatives, multi-compartment or multi-chamber headers may be provided. FIG. 7 schematically shows a section through one such multi-chamber header. Here there are two chambers 91, 92 separated by a dividing wall 93. This dividing wall 93 runs along the length of the header so that the two chambers 91, 92 are arranged longitudinally within the header. Thus, in this case as can be seen in FIG. 7, two of the tube portions 61 in each fin-tube element 6 are in communication with the first chamber 91, whereas the remaining two tube portions 61 in the fin-tube element 6 are in fluid communication with the second chamber 92. The header at the other end of the tube portions 61 may have a similar configuration to that shown in FIG. 7 or may be a single compartment header of the type shown in FIG. 6, depending on the effect which is desired. Whatever configuration is used, such multi-compartment headers can facilitate the provision of counterflow heat exchange within one module or sub unit 8. This is because, the heat exchange fluid running through the tube portions 61 which first meet air flowing through the heat exchanger can have already been routed through the tube portions 61 which receive the air second.

Figure 8:
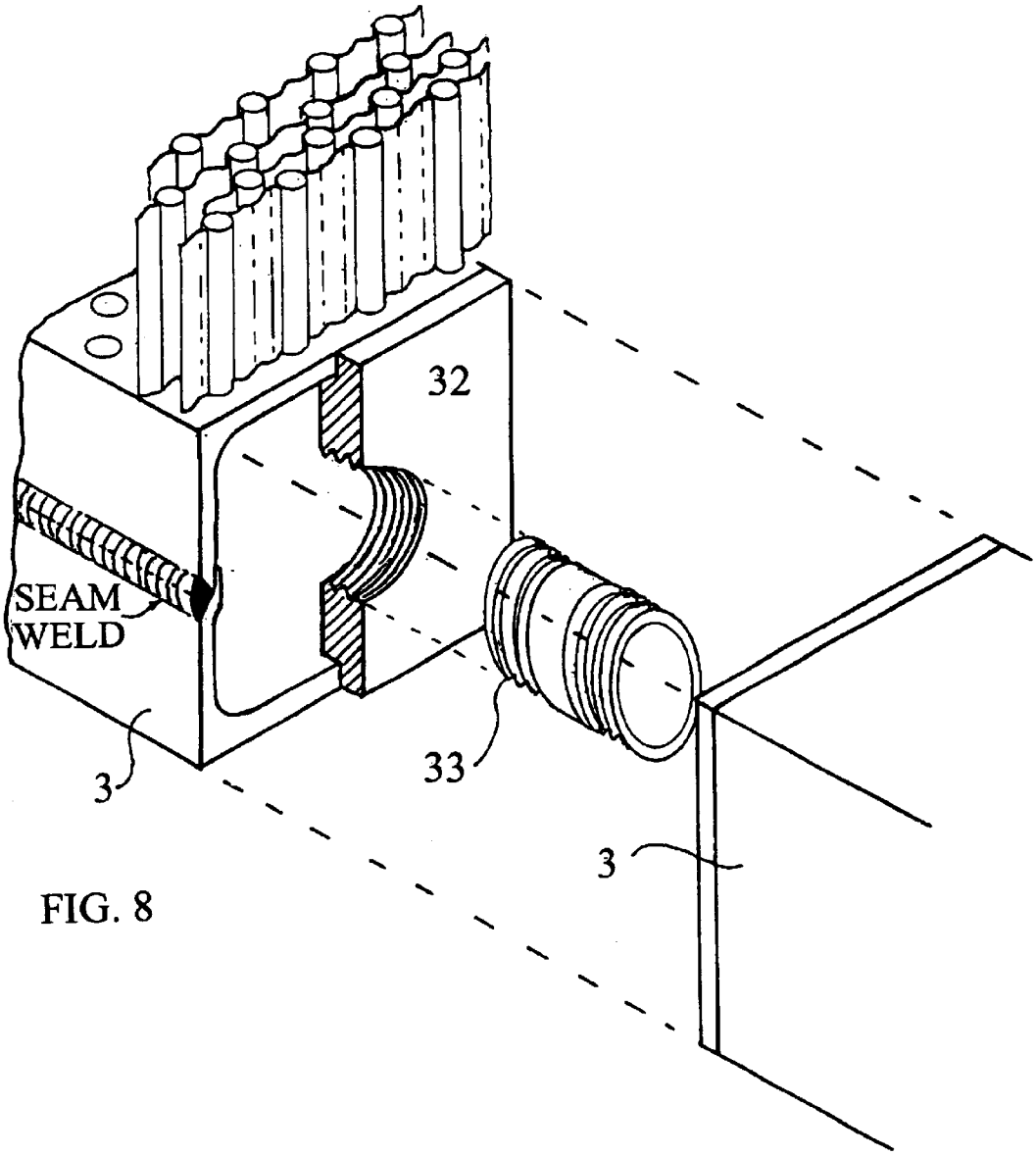
FIG. 8 is a schematic perspective view illustrating one way in which two adjacent headers may be connected to one another.

FIG. 8 schematically shows one possible technique for connecting together adjacent headers 3 which are provided in a row. Here an end plate 32 of each header is provided with a threaded hole and a connecting nipple 33 is used which has appropriate thread for mating with the threads in the two facing end plates 32 such that the headers 3 may be twisted together providing both a physical connection and a fluid communication path between the interiors of the two adjacent headers 3. The nipple may be a left/right handed nipple as used for pulling radiation sections together.

Figure 9:
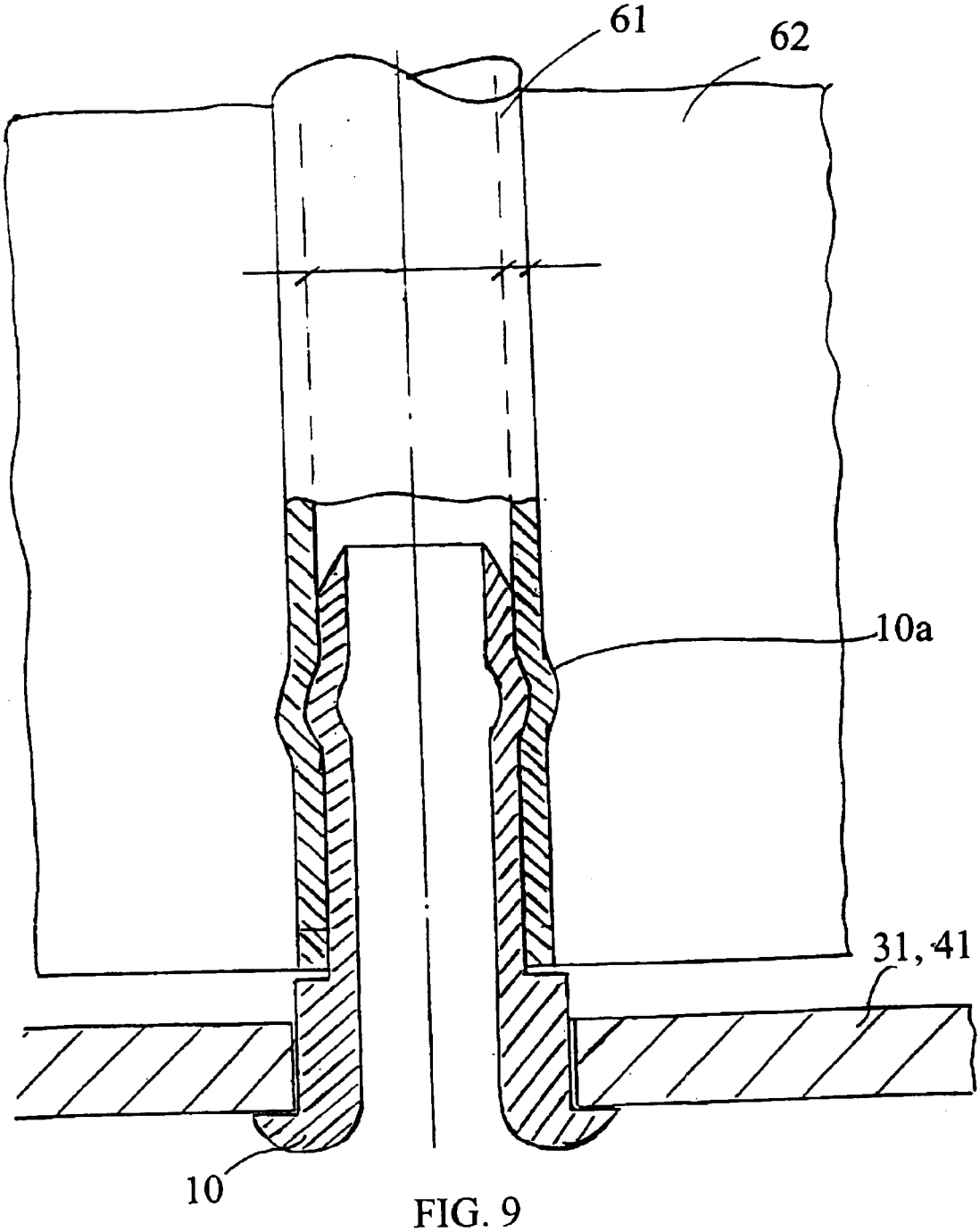
FIG. 9 is a schematic sectional view of one arrangement for fixing a fin-tube element to a header.

FIG. 9 shows an alternative method to aid in fixing of fin-tube elements 6 to the tube receiving portion 31, 41 of a respective header. In this arrangement a nozzle 10 is provided which is expanded into the appropriate aperture formed in the tube receiving portion 31, 41 of the header 3, 4. The nozzle has a part for insertion into the end of the appropriate tube portion 61. Once the nozzle 10 has been inserted into the tube portion 61, it is deformed (or swaged) into the tube portion 61 to provide a sound mechanical connection at the swaged or deformed region 10*a*. Such a technique may be used alone, or in conjunction with another fixing technique, such as the use of an appropriate adhesive such as epoxy resin. In many circumstances the use of such nozzles can be avoided but in some circumstances, for example where high pressures may be used, and in DX systems (where a highly volatile and potentially dangerous refrigerant is flowing as the heat exchange fluid) the heightened level of connection and seal is useful.

Heat exchangers of the type described above have various advantages.

Firstly, their structure is such as to be inherently strong and rigid and in most circumstances, the need for any supporting frame can be removed. Further, the fin-tube elements 6 can be of material which is significantly thicker than existing fins so the heat transfer properties and risk of damage are much reduced and strength increased. The shape of the fin-tube elements 6 is inherently strong. Further, the spacings between adjacent fin-tube elements 6 and more importantly the sinuous air passages therethrough can be significantly wider than in existing heat exchangers whilst still providing a similar efficiency. This can make cleaning the heat exchanger, and more particularly the surfaces defining the air passages, feasible. Further, problems of boundary layer interference in fluid flow can be avoided.

The material used in the fin-tube elements 6 can be aircraft grade Aluminium or Duralumin (RTM) which is much stronger and more resistant to corrosion that soft aluminium used in conventional fins.

Further, the dimension and arrangement of the fin-tube elements 6 can be such as to achieve a better efficiency of heat transfer in general, so that although the total surface area of a heat exchanger according to the present application may be smaller than that in a conventional heat exchanger, its heat transfer capacity compares favourably.

There are further advantages in manufacturing. As will be clear from the above, when making a heat exchanger of the type described in the present application a series of prefabricated extruded aluminium parts may be used. Thus, for example, the fin-tube elements 6 may be made and stocked in standard lengths and cut to size, if necessary, for use in a particular heat exchanger. Similarly, the extruded components of headers 3, 4 may be made and stocked in standard lengths and cut to size if required. Any components such as end caps, nozzles and connecting nipples which are used can also be made and stocked in one or more standard sizes.

Thus, a method of making a heat exchanger of the type described above may generally comprise the steps of selecting appropriate fin-tube elements 6 and header 3, 4 components, cutting these to the desired length, removing portions of the fins 62 at the ends of the tube portions 61, drilling/making holes in the tube receiving portions 31, 41 of the headers 3, 4 (if these are not already present), inserting the exposed tube ends 61 into apertures in the headers, securing the tube ends into the headers and, connecting together the two main parts of the headers if these are of two-part design, securing the end caps on the headers and thus completing either the basis of the whole heat exchanger or one sub-unit. Once this basic unit is made the associated pipework may be fitted and, where appropriate, this module may be fitted together with other modules to continue build up of the whole heat exchanger. Of course, in some cases, various of these steps may be omitted where inappropriate, one example being if ready sized kits are supplied.

The structure of the heat exchanger facilitates a more streamlined manufacturing process, which in some cases, may be at least partially automated. Further, the modularity of the design can lead to additional advantages in manufacture and also in the case of maintenance and repair. For example, in some circumstances even once a heat exchanger has been installed it may be possible to remove one or more modules for cleaning, maintenance or replacement.

In an alternative a natural draft condenser may be made using fin-tube elements of the type described above. Here the fin-tube elements are provided within a duct or tube and this structure is oriented in use so that the tubes are stood on end. The structure might be six metres tall and the idea is that it acts as stack. Hot refrigerant gas is fed into the tube portions at the top of the structure and is caused to flow down through the stack and leave the opposite end of the tube portions as a cool liquid. The cooling would be achieved by cool air which is allowed to enter the tube or duct surrounding the fin-tube elements at the base and rise up through the tube or duct and escape at the top at a higher temperature. It will be appreciated that such a structure makes use of counterflow.

This is one further example of the type of fluid to gas heat exchangers that may be made using the basic ideas of the present application.

Figure 10:
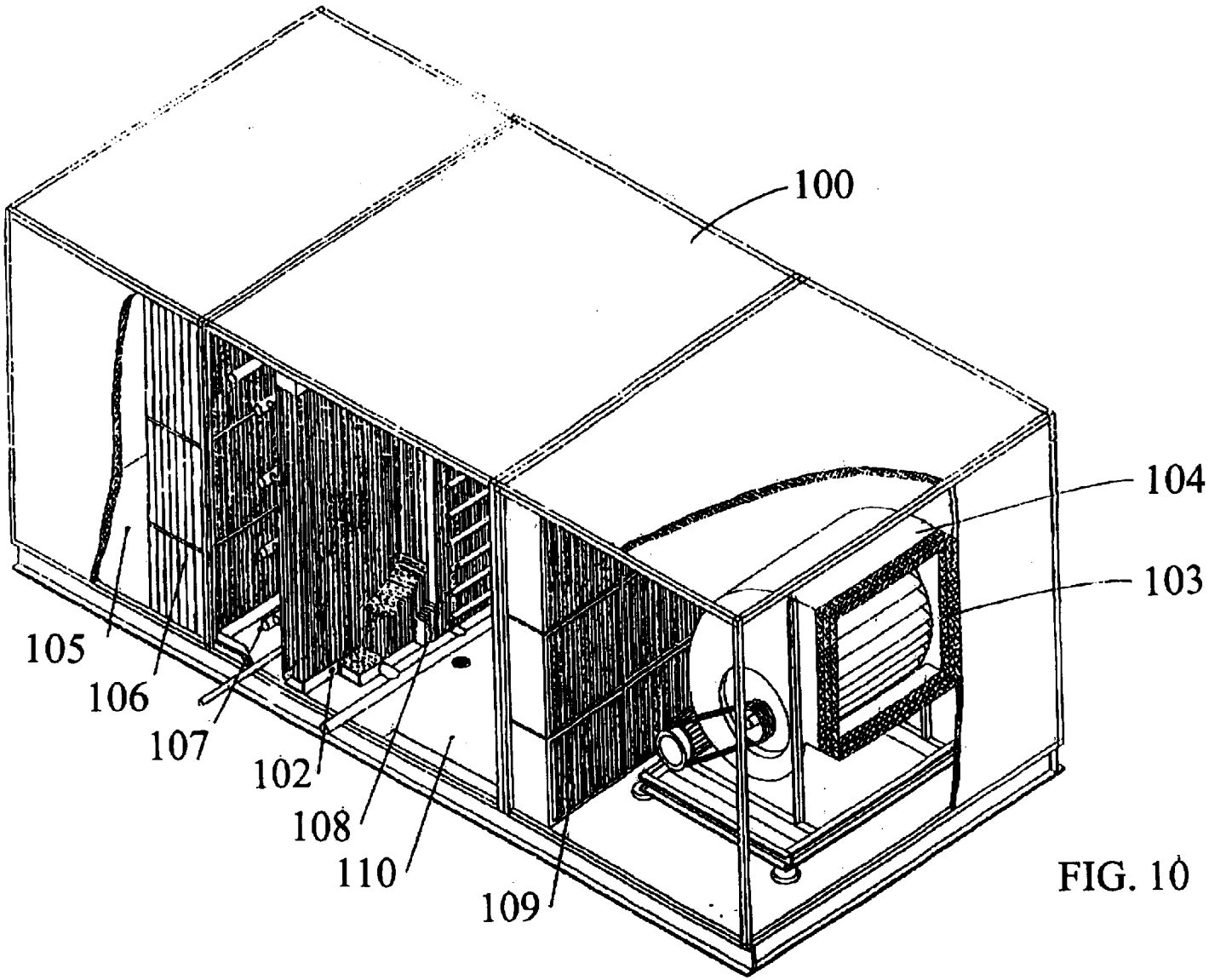
FIG. 10 schematically shows an air handling unit embodying the invention.

FIG. 10 shows an air handling unit 100 which is a further embodiment of the present invention. The air handling unit includes a fluid to gas heat exchanger 101 which is of the same type as that shown and described with reference to FIG. 2. The handling unit 100 however, comprises a number of other components as will be discussed in more detail below. In general terms the air handling unit functions by drawing air in through an inlet (not shown) at one end and expelling the air at the other end via an outlet 103. A centrifugal fan 104 serves to draw the air through the unit. In sequence between the air inlet (not shown) and the air outlet 103 are provided a pre-filtration stage 105, a biogreen filter 106, an automatic washdown station 107, the heat exchanger 102, an ultraviolet air purification station 108 and a secondary filtration stage 109. A drain pan 110 is provided underneath the heat exchanger 102 and in fact extends the whole of the length between the biogreen filter 106 and secondary filtration stage 109. This drain pan is used for collecting liquid used in washing down the heat exchanger 102.

The air handling unit 100 is arranged to act as an air purification system of a type similar to that disclosed in WO 02/04036.

The method of purifying air comprises drawing air into the handling unit, passing the air over surfaces coated with an antimicrobial agent, through ultraviolet radiation (provided in the ultraviolet air purification station 108) and returning the thus treated air to the environment via the outlet 103. It will be appreciated that the air also passes through the pre-filtration stage 105 and the secondary filtration stage 109. The antimicrobial agent can be provided on a number of different surfaces. In the present embodiment the biogreen filter 106 essentially consists of a filter material which might for example by metal wool appropriately coated with the antimicrobial agent. Furthermore, however, the outer surfaces of the fin-tube elements in the cooling coil 102 may also be coated with the antimicrobial agent. A suitable antimicrobial agent is a standard antimicrobial substance (for example a quaternary amine) provided in a silane which when coated on a surface bonds to the surface to render it antimicrobially active. As suggested by the applicants of WO 02/04036 an agent incorporating 3-(trimethoxysilyl)-propyldimethyloctadecyl ammonium chloride as active ingredient as sold by Aegis Environments of Midland, Mich. USA under the trade mark Aegis Microbe Shield is particularly useful.

In other circumstances it may be appropriate to provide other surfaces with such an antimicrobial coating. For example, surfaces making up the ultraviolet air purification section 108 may be so coated.

The ultraviolet air purification station 108 comprises a plurality of individual light sources which are arranged to generate light at the appropriate wavelengths for killing undesirable bacteria and/or fungi, for example in the range of 184 nms to 254 nms.

Using the combination of the heat exchanger of the present application together with the ultraviolet treatment and antimicrobial agents can give rise to a particularly hygienic air handling system. As described above the heat exchangers of the present application are such as to be less likely to build up undesirable products and are easier to clean and furthermore, provide suitable surfaces for coating with an antimicrobial agent.

Positioning the ultraviolet air purification station 108 adjacent the output of the heat exchanger 102 is advantageous as the airflow at this region is turbulent.

What is claimed is:

1. A fluid to gas heat exchanger comprising a plurality of fin-tube elements, each fin-tube element comprising at least one respective tube portion for carrying heat exchange fluid and at least one respective fin portion which is in contact with the tube portion and arranged for encouraging exchange of heat between fluid in the tube portion and the surroundings, wherein the respective tube portions and respective fin portions run side by side, the fin portions have a sinuous profile and the plurality of fin-tube elements are arranged relative to one another to define at least one respective sinuous airflow path therebetween for encouraging turbulent but free flowing airflow along said at least one respective sinuous airflow path.

2. A heat exchanger according to claim 1 in which the fin portion comprises a root portion where it meets the tube portion, the root portion being thicker than the remainder of the fin portion.

3. A heat exchanger according to claim 1 in which the fin-tube element is integrally formed.

4. A heat exchanger according to claim 1 in which the fin-tube element is an extrusion.

5. A heat exchanger according to claim 1 in which the fin-tube element comprises a plurality of tube portions, which are linked to one another via respective fin portions.

6. A heat exchanger according to claim 1 in which the fin-tube elements are shaped and arranged to allow dense packing, such that the spacing between adjacent fin-tube elements is less than the outside diameter of the tube portions.

7. A heat exchanger according to claim 1 in which, at least one of, the shape of the fin-tube element, and the inter-arrangement of a plurality of fin-tube elements where more than one fin-tube element is provided, is chosen to encourage heat transfer to a fluid flowing past the fin-tube element.

8. A heat exchanger according to claim 1 in which the fin portion runs along substantially the whole length of the respective tube portion.

9. A heat exchanger according to claim 1 in which substantially the whole length of the fin portion is in contact with the respective tube portion.

10. A heat exchanger according to claim 1 in which comprises at least one header, an interior of which is in fluid communication with the interior of the tube portion.

11. A heat exchanger according to claim 10 in which the header comprises a tube receiving portion and the header is arranged so that the operation of connecting the tube portion to the header may be at least partially performed from a side of the tube receiving portion which will be in the eventual interior of the header.

12. A heat exchanger according to claim 10 having a plurality of headers, there being at least one of appropriate chambers and connections within at least one of the headers to allow counterflow heat exchange to occur.

13. A heat exchanger according to claim 1 which comprises a plurality of sub units each of which sub units comprise a respective spaced pair of headers between which is disposed at least one respective fin-tube element having at least one tube portion to provide a fluid path between the interiors of the two headers.

14. A heat exchanger according to claim 13 in which the sub units are arranged and connected together in such a way as to allow counterflow heat exchange to occur.

15. A heat exchanger according to claim 1 in which an external surface of the fin-tube element is coated with an antimicrobial agent.

16. A heat exchanger according to claim, 15 in which the antimicrobial agent is an antimicrobial substance in a silane.

17. An air handling unit comprising a heat exchanger according to claim 1 and an ultraviolet radiation section for irradiating air before, during or after passage through the heat exchanger.

18. A method of manufacturing a fluid to gas heat exchanger having at least one pair of headers and at least one fin-tube element which comprises at least one tube portion for carrying heat exchange fluid and at least one respective fin portion which is in contact with the tube portion and arranged for encouraging exchange of heat between fluid in the tube portion and the surroundings wherein the tube portion and fin portion run side by side, the fin portion has a sinuous profile and the fin-tube element is an extrusion with the tube portion and fin portion being integrally formed with one another, the method comprising the step of:

connecting the at least one fin-tube element between the pair of headers so as to provide a fluid communication path between interiors of the headers via the tube portion.

19. A method according to claim 18 comprising the further steps of:

connecting a plurality of fin-tube elements between the pair of headers;

using pre-fabricated standard fin-tube and header components; and cutting each fin-tube element to a desired length before assembly.

20. A method according to claim 18 in which step of connecting the fin-tube element to the headers comprises processing from the eventual interior of each header.

21. A method according to claim 20 wherein each header comprises a tube receiving portion and at least one other part which is initially separate from the tube receiving portion so as to allow access to a side of the tube receiving portion which will eventually face the interior of the header, and the step of connecting the fin-tube element to each header comprises the steps of first performing at least part of the operation for connecting the tube portion to the header from the side of the tube receiving portion which will eventually face the interior of the header and second, connecting together the tube receiving portion and the at least one other part.

22. A method according to claim 18 comprising the steps of making a plurality of sub units by connecting at least one respective fin-tube element between a respective pair of headers so as to provide a fluid communication path between interiors of the headers via the tube portion and connecting together the sub units to form the heat exchanger.

23. A fin-tube element for a fluid to gas heat exchanger, the element comprising at least one tube portion for carrying heat exchange fluid and at least one respective fin portion which is in contact with the tube portion and arranged for encouraging exchange of heat between fluid in the tube portion and the surroundings, wherein the tube portion and fin portion run side by side the fin portion has a sinuous profile, and the fin-tube element is an extrusion with the tube portion and fin portion being integrally formed with one another.

24. A fluid to gas heat exchanger sub unit comprising a spaced pair of headers between which is disposed at least one fin-tube element according to claim 23, wherein the at least one tube portion provides a fluid path between the interiors of the two headers.

25. A fin-tube element according to claim 23 comprising at least two tube portions which are connected to one another by the fin portion, the fin-tube element being an integral extrusion.

26. A fin-tube element according to claim 25 in which the fin-tube element is generally planar such that the tube portions and fin portion lie along a common plane.

27. A fluid to gas heat exchanger comprising at least one fin-tube element which comprises at least one tube portion for carrying heat exchange fluid and at least one respective fin portion which is in contact with the tube portion and arranged for encouraging exchange of heat between fluid in the tube portion and the surroundings, wherein the tube portion and fin portion run side by side and the fin portion has a smoothly varying sinuous profile.

28. A fluid to gas heat exchanger according to claim 1 in which at least the plurality of fin-tube elements are made of metallic material.

29. A fluid to gas heat exchanger according to claim 1 in which at least the plurality of fin-tube elements are made of one of aluminum and aluminum alloy.

30. A fin-tube element according to claim 23 which is made of metallic material.

31. A fin-tube element according to claim 23 which is made of one of aluminum and aluminum alloy.

32. A fluid to gas heat exchanger comprising a plurality of fin-tube elements, each fin-tube element comprising at least one respective tube portion for carrying heat exchange fluid and at least one respective fin portion which is in contact with the tube portion and arranged for encouraging exchange of heat between fluid in the tube portion and the surroundings, wherein the respective tube portions and respective fin portions run side by side, the fin portions have a sinuous profile and the plurality of fin-tube elements are arranged relative to one another to define at least one respective airflow path therebetween which comprises a series of throats to encourage turbulent air flow.

33. A method according to claim 18 in which at least the fin-tube element is made of metallic material.

34. A method according to claim 18 in which at least the fin-tube element is made of one of aluminum and aluminum alloy.

* * * * *